US009445176B1

(12) United States Patent
Yeh

(10) Patent No.: US 9,445,176 B1
(45) Date of Patent: Sep. 13, 2016

(54) EARPIECE APPARATUS FOR IN-EAR HEADPHONES

(71) Applicant: Chia-Ling Yeh, Hsinchu (TW)

(72) Inventor: Chia-Ling Yeh, Hsinchu (TW)

( * ) Notice: Subject to any disclaimer, the term of this patent is extended or adjusted under 35 U.S.C. 154(b) by 0 days.

(21) Appl. No.: 14/681,100

(22) Filed: Apr. 8, 2015

(51) Int. Cl.
*H04R 25/00* (2006.01)
*H04R 1/10* (2006.01)
*H04R 5/033* (2006.01)

(52) U.S. Cl.
CPC ..... *H04R 1/1016* (2013.01); *H04R 1/1075* (2013.01); *H04R 5/033* (2013.01); *H04R 25/604* (2013.01); *H04R 25/652* (2013.01); *H04R 2225/025* (2013.01); *H04R 2460/11* (2013.01)

(58) Field of Classification Search
CPC H04R 1/1008; H04R 1/1016; H04R 1/1041; H04R 1/1075; H04R 1/1091; H04R 5/033; H04R 2460/09; H04R 2460/11; H04R 25/604; H04R 25/652; H04R 2225/025
USPC ..... 381/309, 71.6, 72, 370, 371, 372, 373, 381/380; 379/430; 181/129, 130
See application file for complete search history.

(56) References Cited

U.S. PATENT DOCUMENTS

RE37,398 E * 10/2001 Nageno ..... H04R 5/033 381/370
8,565,467 B1 * 10/2013 Tseng ..... H04R 1/1016 181/129
2007/0177753 A1 * 8/2007 Weinans ..... H04R 1/1041 381/373

* cited by examiner

*Primary Examiner* — Huyen D Le
(74) *Attorney, Agent, or Firm* — Leong C. Lei

(57) ABSTRACT

An earpiece apparatus for in-ear headphones, includes two shells, each having a speaker and an extending sound output hole, wherein at least one mounting hole is positioned on the outer surface of said shells, said mounting hole is not positioned opposite to said sound output hole, a vibrating structure is correspondingly positioned on said mounting hole, said vibrating structure contacts the earlap, said vibrating structure comprises a vibrating diaphragm and a flexible piece, said vibrating diaphragm is fixed on said flexible piece, said vibrating diaphragm is made of thin metal, plastic, or paper etc. membrane material, and said flexible piece is made of a soft material, and when the sound waves produced from said speaker vibrate within said shell, said flexible piece and said vibrating diaphragm vibrate accordingly along with the sound waves passing through.

6 Claims, 5 Drawing Sheets

EARPIECE APPARATUS FOR IN-EAR HEADPHONES

BACKGROUND OF THE INVENTION

1. Technical Field

The present invention relates to the field of headphones, and particularly to an earpiece apparatus for in-ear headphones, which can make full use of the sound that is dispersed for reducing the impact on eardrum.

2. Background of the Invention

With the continuous development of new technologies and new materials, audio-visual quality expectations of people have also increased. New sound devices, such as headphones, sound systems are developed one after another, and in-ear headphones are developed in order to improve the sound-proofing effect of headphones. By means of the colloidal plug part entering into the external auditory canal, it is possible to reduce external noise and obtain better sealing.

Since it has favorable sealing feature, while the speaker found within the headphone earpiece produces sound, it constantly vibrates to produce impact waves, which prevent the air found outside the outer shell from coming into contact with the speaker and the user's ear. However, said impact waves can not be dispersed either, and can possibly hit the user's ear, which would easily cause discomfort for the user. As a result, some dealers place sound dispersion holes on the earpiece to avoid this kind of discomfort. FIG. 1 is a drawing of the earpiece apparatus 1 according to the prior art, which comprises an outer shell 11, and a sound output hole 111 and at least one sound dispersion holes 112 are positioned on said outer shell 11, and said sound dispersion holes 112 depart from said sound output holes 111. However, only the sound dispersion holes 112 are found in the prior art, and the other end of the sound output hole 111 outer shell 11 is found at the opposite side of the sound dispersion holes 112. When sound dispersion holes 112 are positioned at this place, they would cause unnecessary dispersion of the sound waves, and these sound waves that are dispersed out can not be heard by the user and more importantly, would cause the people around the user feel noisy and uncomfortable.

In light of this, the inventor has made extensive studies to improve this technique, and according to his years of experience in the related technical field, he was able to provide a new style of earpiece apparatus for in-ear headphones in order to overcome above said prior art problems.

SUMMARY OF THE INVENTION

A purpose of the present invention is to provide an earpiece apparatus for in-ear headphones, wherein said earpiece apparatus can reduce the impact of sound on eardrum, and enable the sound waves, which are dispersed for reducing the impact, be heard by the user.

In order to achieve above given purpose, the in-ear headphone earpiece apparatus of the present invention comprises two shells, each of which have a speaker and a sound output hole extending from one end thereof, and it is characterized in that: at least one mounting hole is positioned on the outer surface of said shells, said mounting hole is not positioned opposite to said sound output hole, a vibrating structure with a shape that corresponds to the shape of said mounting hole is installed on said mounting hole, said vibrating structure contacts the earlap of the ear, said vibrating structure comprises a vibrating diaphragm and a flexible piece, said vibrating diaphragm is fixed on said flexible piece, said vibrating diaphragm is made of thin metal or plastic or paper etc. membrane material, and said flexible piece is made of a soft material, and when the sound waves produced from said speaker vibrate within said kind of shell, said flexible piece and said vibrating diaphragm can vibrate accordingly along with the sound waves passing through, and thus the sound waves that are not transmitted out via said sound output hole are transmitted out via said vibrating structure, and there is an angle of 10 to 120 degrees between the sound output direction of said sound output hole and the sound output direction of said vibrating structure, wherein this angle may change according to different shell structures.

Said shell is formed of a front shell, an inner shell, and a rear shell. Said inner shell is fixed into said rear shell, and said front shell forms a closed structure together with said rear shell. Said speaker is connected with said inner shell, said sound output hole is positioned on said front shell, and said mounting hole is positioned on said rear shell. In this way, sufficient resonance cavity is provided for the sound waves that are spread from the speaker, so that adequate resonance is generated.

Besides, a protective net is covered on said mounting hole, and said protective net prevents dust from coming into contact with said vibrating structure, said protective net is made of metal, and said protective net is formed of two layers of metal nets on top of each other, and the grids of these two layers do not overlap at all. In this way, the grid of the protective net would be reduced, which makes it harder for dust to come into contact with the vibrating structure.

As a result, by means of reducing the impact of the part of sound waves transmitted out from the earpiece apparatus, on the eardrum, via the vibrating structure, and also by having a certain angle between the sound output angle of the vibrating structure and the sound output angle of the sound output hole, and thus directing the sound output direction of the vibrating structure towards the earlap, the vibration of the sound waves can be re-transmitted back to the eardrum, and in this way, partial transmissions can prevent the ears from being exposed to excessive impact in a moment, and also enable the user also hear the sound waves that were transmitted out.

DETAILED DESCRIPTION OF THE PREFERRED EMBODIMENTS

In order to let the esteemed examiner understand the contents of the present invention better, figures are attached in accordance with the below given description, and identical components provided in the below given embodiments are explained with identical reference numbers for convenience.

Figure 2:
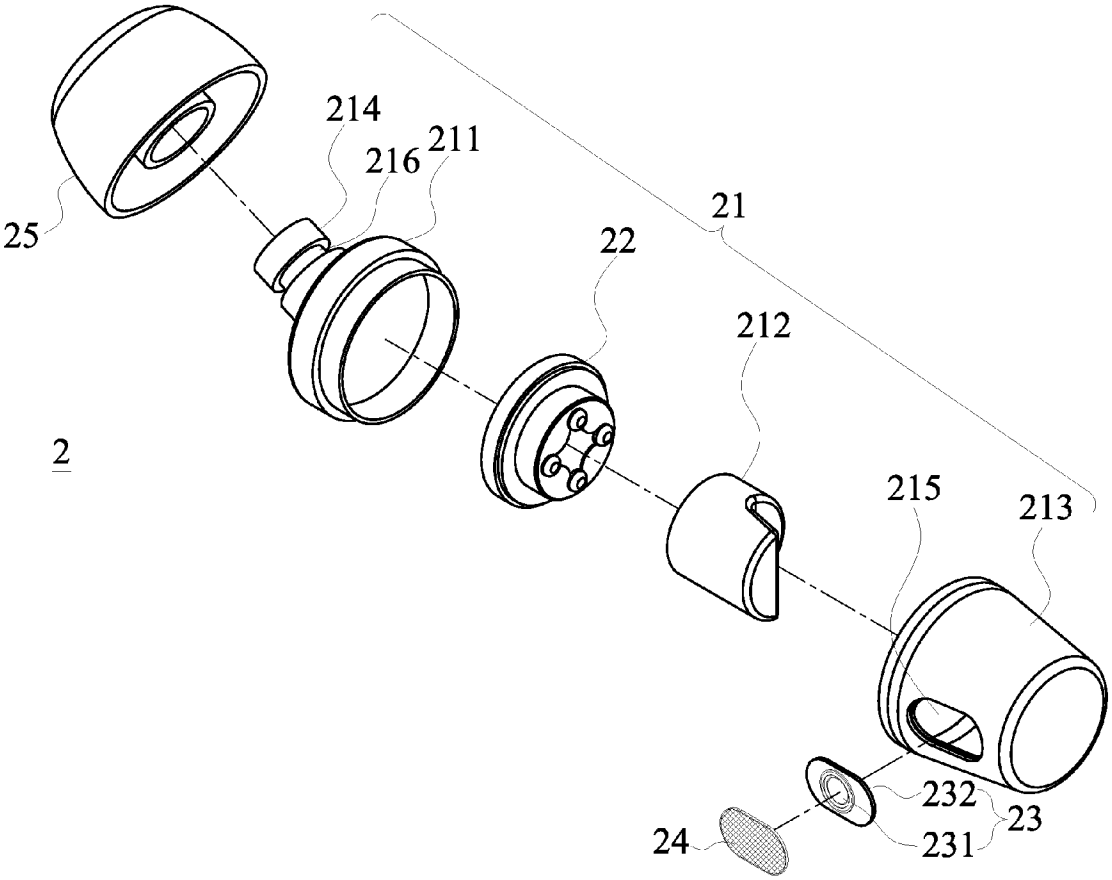
FIG. 2 is an exploded view of the first embodiment of the present invention.
Figure 3:
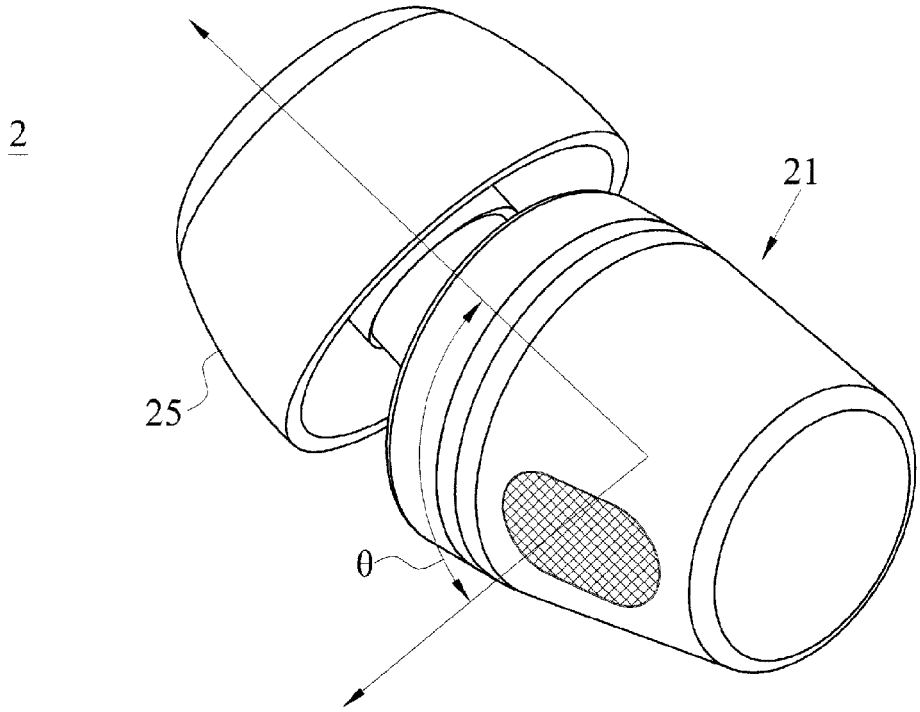
FIG. 3 is a three dimensional view of the first embodiment of the present invention.
Figure 4:
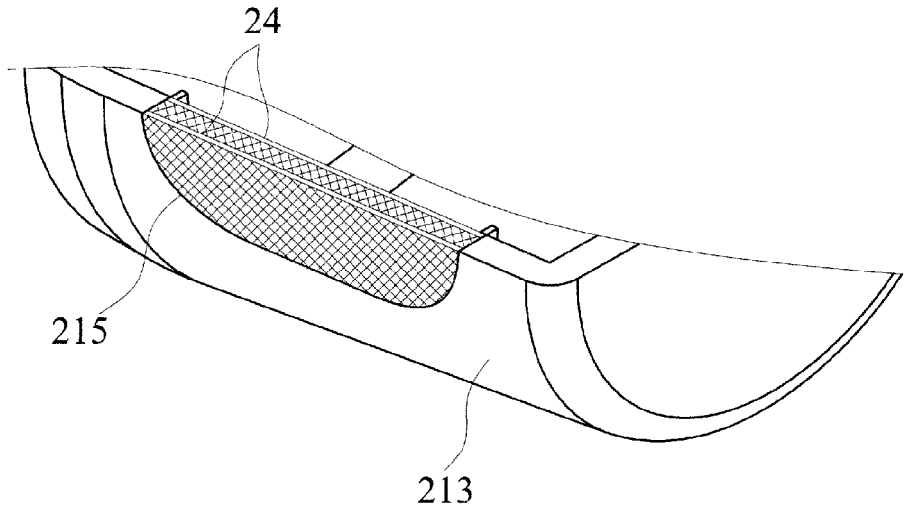
FIG. 4 is a view of the protective net of the first embodiment of the present invention.

In FIGS. 2 to 4, an exploded view, a three dimensional view, and a view of the protective net of the first embodiment of the present invention are given. As shown in FIGS. 2 to 4, the present invention earpiece apparatus 2 for in-ear headphones comprises two shells 21, wherein a speaker 22 is installed in each one of said shells 21, and an extending sound output hole 214 is found at one end of each shell 21. In this way, sufficient resonance cavity is provided for the sound waves that are spread from said speaker 22, so that adequate resonance is generated.

The present invention is characterized in that: each one of said shells 21 are formed of a front shell 211, an inner shell 212, and a rear shell 213. Said inner shell 212 is fixed into said rear shell 213, and said front shell 211 forms a closed structure together with said rear shell 213. Said speaker 22 is connected with said inner shell 212, said sound output hole 214 is positioned on said front shell 211, and at least one mounting hole 215 is positioned on the outer surface of said rear shell 213. Said mounting hole 215 is not positioned in an opposite position to said sound output hole 214. A vibrating structure 23 with a shape that corresponds to the shape of said mounting hole 215 is installed on said mounting hole 215. Said vibrating structure 23 contacts the earlap 3 of the ear. Said vibrating structure 23 comprises a vibrating diaphragm 231 and a flexible piece 232. Said vibrating diaphragm 231 is fixed on said flexible piece 232. Said vibrating diaphragm 231 is made of thin metal, plastic, or paper etc. membrane materials that have favorable audio response, such as diamonds, beryllium alloys, titanium alloys, aluminum alloys, polymer compounds, fiberglass, carbon fiber, paper making fiber etc. and fixed on said flexible piece 232 by means of electroplating, evaporation-plating, printing, or fitting etc. methods. Moreover, said flexible piece 232 is made of a soft material with lack-of-memory property, such as rubber. When the sound waves produced from said speaker 22 vibrate within said kind of shell 21, said flexible piece 232 and said vibrating diaphragm 231 can vibrate accordingly along with the sound waves passing through, and thus the sound waves that are not transmitted out via said sound output hole 214 are transmitted out via said vibrating structure 23.

Figure 7:
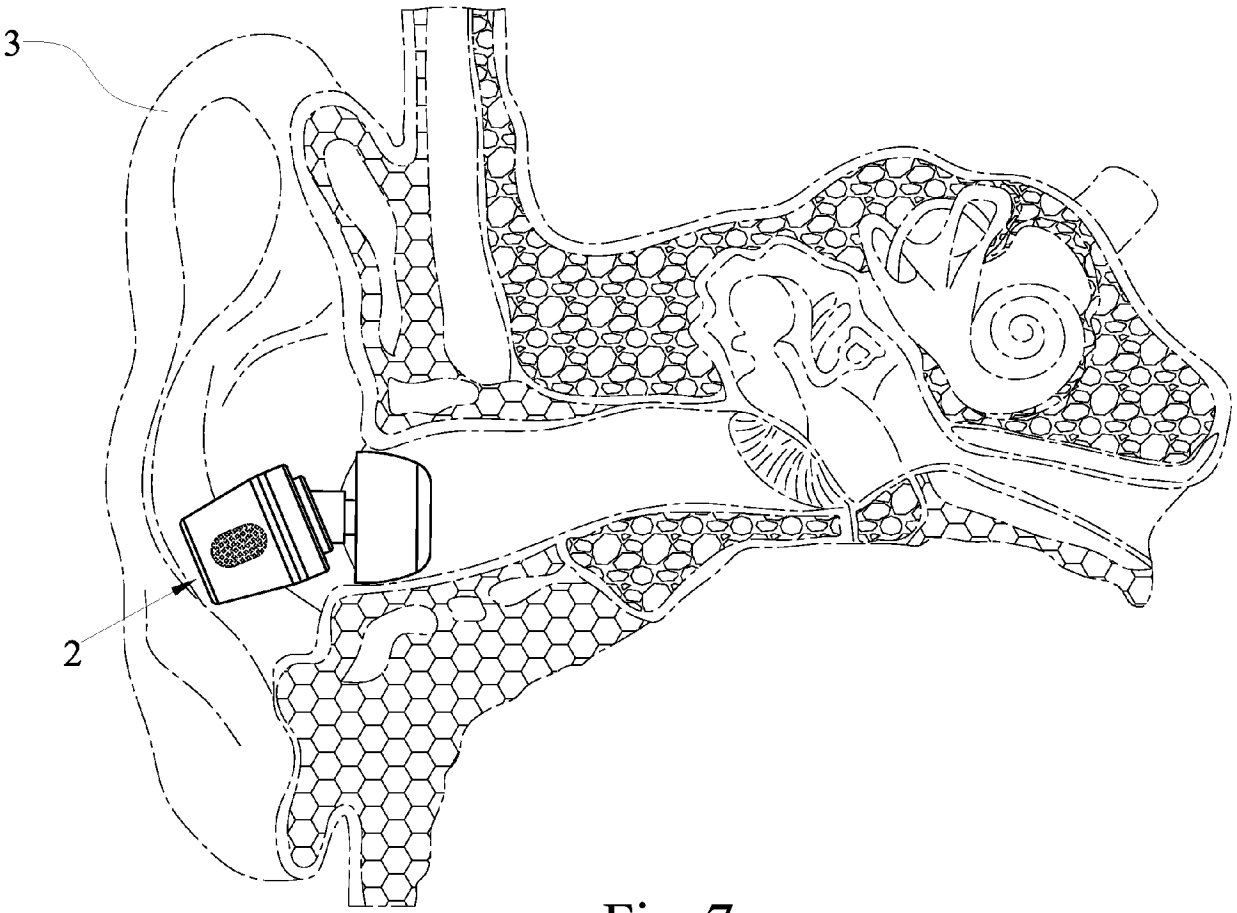
FIG. 7 is a view showing the use of the present invention.

In FIG. 7, a view showing the use of the present invention is given. As shown in FIG. 7, while using the apparatus 2, the user places the earpiece apparatus 2 produced according to the present invention, into his/her ear canal. The speaker 22 installed within the earpiece apparatus starts to broadcast music. After the music is given out from said speaker 22, first of all, it continuously vibrates within the resonance cavity formed with the confined structure of said front shell 211 and said rear shell 213. Most of the sound waves of the music would be transmitted through said sound output hole 214 and directly reach the eardrum, and by means of causing vibration in the eardrum accordingly, enables the user listen to the broadcasted music. Yet, the remaining part of sound waves of the music are broadcasted out through the vibrating structure 23 installed on said mounting hole 215.

Moreover, between the sound output direction of said vibrating structure 23 and the sound output direction of said sound output hole 214, there would be an angle of 10 to 120 degrees, which is shown as θ in the figures, and this angle (θ) is preferably, but not limited to, 35 degrees, 55 degrees, 75 degrees, and as shown in FIG. 3, between 85-90 degrees, and with different shells 21, it is possible to obtain different angles. In this way, the sound output direction of said vibrating structure 23 would remain within the range covered by the earlap 3. If this angle range is exceeded, the sound waves spread from said vibrating structure 23 wouldn't be practically received by the user. However, the vibrating structure 23 designed according to the present invention also contacts with the earlap 3 of the ear or stays within approximately 1 centimeter distance from the earlap 3, so that the sound waves transmitted out via said vibrating structure 23 can also reach the eardrum thanks to being transmitted again via the earlap 3. Moreover, the sound waves conveyed through the air and the sound waves conveyed through the human body are different in terms of sense of hearing, such that one has increased bass effect than the other, and as a result, different kinds of listening pleasure can be provided to the user. At the same time, since some part of the sound waves are transmitted out through said vibrating structure 23, therefore, the momentary impact received by the eardrum would be effectively reduced, and thus the uncomfortable feeling of the user caused at the eardrum because of the sound wave impact would also be reduced.

In addition, a protective net 24 is covered over said mounting hole 215. Said protective net 24 prevents dust from coming into contact with said vibrating diaphragm 231 of said vibrating structure 23 or prevents oil stain, sweat etc. substances that might be left on user's hand from coming into contact with said vibrating diaphragm 231 or said flexible piece 232. In case, said vibrating diaphragm 231 or said flexible piece 232 is contaminated with oil stain, dust, or sweat etc. substances, since the weight ratio would not be equal anymore, when said vibrating diaphragm 231 or said flexible piece 232 vibrates, they can not generate the same regular vibration as before, and therefore, may cause said vibrating structure 23 fail to operate normally, and then the sound waves transmitted out from said vibrating structure 23 wouldn't be as expected anymore. Said protective net 24 is made of metal, and said protective net 24 is formed of two layers of metal nets that are fitted on top of each other, and the grids of these two metal nets do not overlap at all. In this way, the whole grid of said protective net formed after placing layers on top of each other would be even more reduced, and thus the mesh diameter of said protective net 24 would be reduced down to between 0.05 mm to 0.1 mm, which makes it harder for dust to come into contact with said vibrating structure 23.

Figure 5:
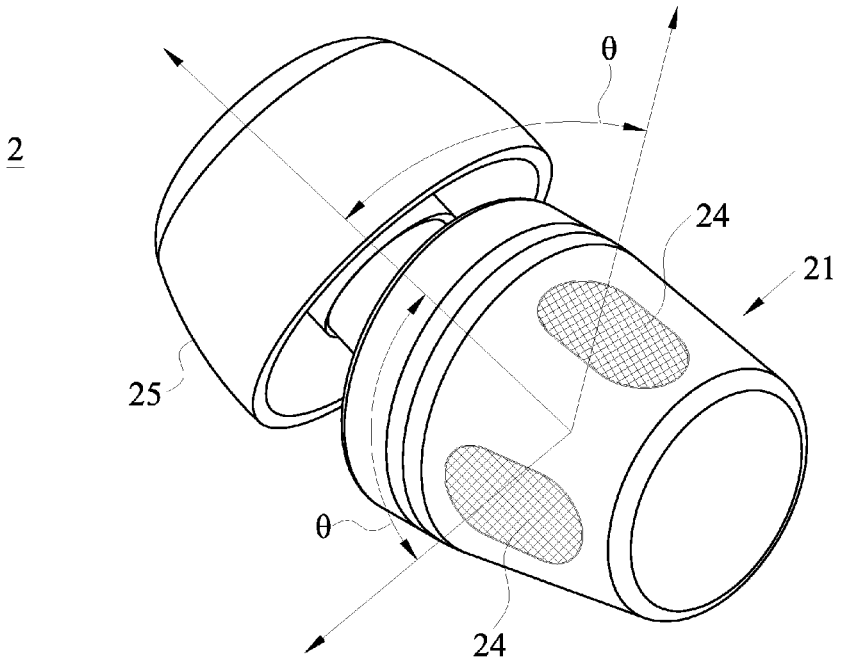
FIG. 5 is a three dimensional view of the second embodiment of the present invention.
Figure 6:
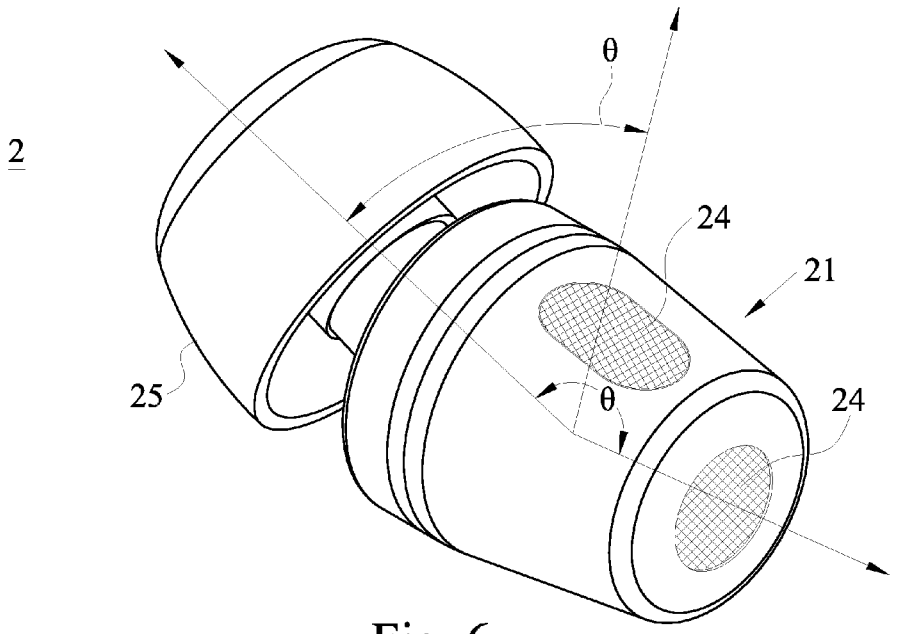
FIG. 6 is another three dimensional view of the second embodiment of the present invention.

In FIGS. 5 and 6, two three dimensional views of the second embodiment of the present invention are given. As shown in FIGS. 5 and 6, more than one mounting holes 215 are provided in the embodiments in order to further improve the distribution effect of sound waves. Moreover, since each one of said vibrating structures 23 installed on said mounting holes 215 can fit completely or partially on the earlap 3, therefore the bass effect generated by conveying sound waves through human body would also be increased accordingly, and therefore the listening pleasure provided to the user with the present embodiment and the listening pleasure provided to the user with the first embodiment would be different.

Figure 1:
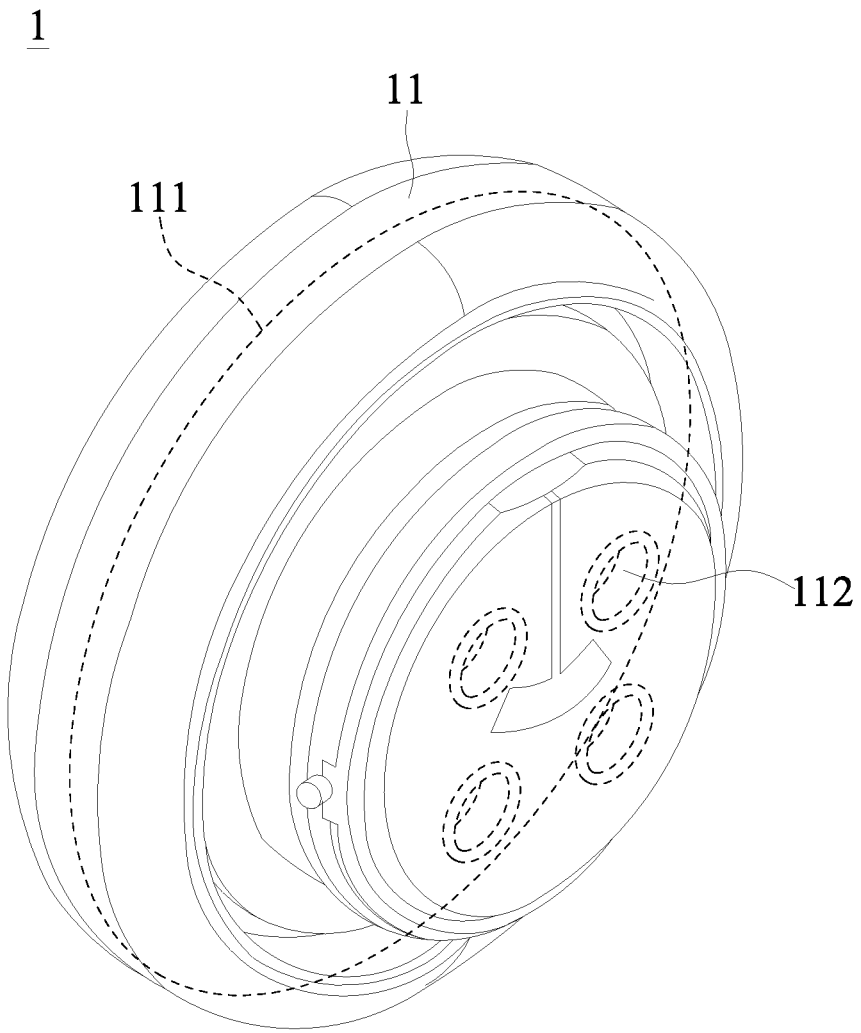
Fig. 1(PRIOR ART)
FIG. 1 is a view of the prior art technique.

With this design, the present invention can achieve the purpose of reducing the impact of said speaker 22 on the eardrum, and also provide enable the part of the sound wave that is originally transmitted out in order to reduce the impact to be gathered back again and listened by the user. Moreover, when compared with the sound dispersion hole 112 of the prior art technique shown in FIG. 1, the present invention apparatus wouldn't cause the surrounding people feel noisy and uncomfortable; because, the sound waves transmitted out via said vibrating structure 23 would be transmitted back to the eardrum by means of the vibration medium formed at the earlap 3 of the ear, which generates a feeling like surround sound effect for the user. The present invention also comprises an annular groove 216 on said front shell 211 in order to fit an ear plug 25, so that the present invention could be readily fitted into the ear canal and wouldn't fall off easily.

What is claimed is:

1. An earpiece apparatus for in-ear headphones, comprising two shells, wherein a speaker and a sound output hole extending from one end of the shell are positioned within each one of said shells, and it is characterized in that;

at least one mounting hole is positioned on the outer surface of said shells, said mounting hole is not positioned opposite to said sound output hole, a vibrating structure with a shape that corresponds to the shape of said mounting hole is installed on said mounting hole, said vibrating structure comprises a vibrating diaphragm and a flexible piece, said vibrating diaphragm is fixed on said flexible piece, and when the sound waves produced from said speaker vibrate within said shell, said flexible piece and said vibrating diaphragm can vibrate accordingly along with the sound waves passing through, and thus the sound waves that are not transmitted out via said sound output hole are transmitted out via said vibrating structure, wherein, there is an angle of 10 to 120 degrees between a sound output direction of said sound output hole and a sound output direction of said vibrating structure, wherein, said shell is formed of a front shell, an inner shell, and a rear shell, said inner shell is fixed into said rear shell, and said front shell forms a closed structure together with said rear shell, said speaker is connected with said inner shell, said sound output hole is positioned on said front shell, and said mounting hole is positioned on said rear shell.

2. The earpiece apparatus for in-ear headphones according to claim 1, wherein, said vibrating structure contacts with the earlap of the ear.

3. The earpiece apparatus for in-ear headphones according to claim 1, wherein, a protective net is mounted on said mounting hole, and said protective net prevents dust from coming into contact with said vibrating structure.

4. The earpiece apparatus for in-ear headphones according to claim 3, wherein, said protective net is formed of a double-layered structure having two grid layers which do not overlap at all.

5. The earpiece apparatus for in-ear headphones according to claim 3, wherein, said protective net is made of metal.

6. The earpiece apparatus for in-ear headphones according to claim 1, wherein, said vibrating diaphragm is made of thin metal, plastic, paper, or ceramics, and said flexible piece is made of a soft material.

* * * * *